United States Patent [19]

Kennepohl et al.

[11] 4,079,158

[45] Mar. 14, 1978

[54] ASPHALT IMPREGNATED FELT BUILDING MATERIALS

[75] Inventors: Gerhard J. A. Kennepohl, Oakville; Laverne J. Miller, Georgetown; David C. Bean, Oakville, all of Canada

[73] Assignee: Gulf Oil Canada Limited, Toronto, Canada

[21] Appl. No.: 620,473

[22] Filed: Oct. 7, 1975

[51] Int. Cl.[2] ..... E04D 1/00

[52] U.S. Cl. ..... 428/143; 427/442; 428/144; 428/280; 428/281; 428/291; 428/489; 428/491; 428/920; 428/921

[58] Field of Search ..... 428/280, 281, 288, 291, 428/489, 920, 491, 921, 245, 282, 289, 318, 141, 142, 143, 144; 106/274, 275, 287 SC; 427/442

[56] References Cited

U.S. PATENT DOCUMENTS

| | | | |
|---|---|---|---|
| 95,576 | 10/1869 | Field et al. | 428/491 |
| 256,368 | 4/1882 | Pöschel | 428/491 |
| 1,026,855 | 5/1912 | Ellis | 428/491 |
| 1,264,932 | 5/1918 | Henderson | 106/274 |
| 1,765,778 | 6/1930 | Schutte | 427/442 |
| 1,846,186 | 2/1932 | Cline et al. | 106/274 |
| 2,804,833 | 9/1957 | Berry et al. | 428/143 |
| 3,738,853 | 6/1973 | Hopvillem | 106/275 |
| 3,810,857 | 5/1974 | Garrigues et al. | 106/274 |

*Primary Examiner*—James J. Bell
*Attorney, Agent, or Firm*—D. R. Morrison

[57] ABSTRACT

The disclosure describes asphalt saturated felt building materials, optionally having a mineral filled asphalt base coating thereon, in which the asphalt saturating the felt and/or the asphalt in any mineral filled coating is a blend of 10–55% sulfur dispersed in the asphalt. The materials are used in the conventional manner as roofing felt, roofing shingles, and in built-up roofing, to obtain improved fire resistance.

9 Claims, No Drawings

ASPHALT IMPREGNATED FELT BUILDING

MATERIALS

This invention relates to building materials, particularly the type based on webs of asphalt saturated paper felt, and more particularly to the so called asphalt shingle type having an asphalt saturated felt backing with a layer of asphalt bound mineral filler mixture coated thereon and optionally a finishing coat of reflective (and optionally decorative) finely divided stone coated on the weather-exposed surface. Asphalt shingles of this type constitute the most common roofing material used throughout North America today for private residential buildings, and owe their popularity to their combination of effectiveness as a weather-repellant finish (especially for sloped roofs), durability, and low cost. The expression "paper felt" when used throughout this specification and ensuing claims is intended to include all porous webs of felted or woven fibrous materials suitable for saturation and optionally coating with asphaltic based saturants and coatings to form building materials.

The recent sharply increased costs of petroleum products, including those of the grades of asphalt used in asphalt felt building materials, have prompted a search for materials that might be substituted, at least in part, for the grades of asphalt used in building materials, particularly asphalt shingles. In general, two different grades of asphalt are used in the manufacture of a roofing material. The first is a felt saturant grade used to impregnate the felt backing, which backing gives the material its main tensile strength and tear resistance, and the second is a coating grade which generally is extended with inert mineral filler to make a coating which gives the roofing material its durability. Typical (but not exclusive) ranges of properties for some saturant grades of asphalts commercially available are given in Table I as specified by the American Roofing Manufacturers Association (ARMA):

TABLE I

| FELT SATURANTS | | | |
|---|---|---|---|
| | Limits for Property | | ASTM |
| Property | Minimum | Maximum | Test Procedure |
| Softening Point (R&B) ° F (° C) | 140(60) | 155(68) | D-2398 |
| Flash Point (COC) ° F (° C) | 500(260) | — | D-92 |
| Pen at 32° F (0° C) 200g,60sec,dmm | 3 | — | D-5 |
| at 77° F(25° C) 100g,5sec,dmm | 18 | 50 | D-5 |
| at 115° F (46° C) 50g,5sec,dmm | — | 150 | D-5 |
| Ductility at 77° F (25° C)cm | 10 | — | D-113 |
| Ductility at 40° F (4° C)cm | 3 | — | D-113 |
| Volatility at 325° F (165° C), 5 hours, % loss | — | 0.5 | D-6 |
| Total Bitumen Soluble in trichloroethylene, % | 99.5 | — | D-2042 |
| High Temperature Stability, Softening Point after Test, R&B | 140(60) | 155(68) | D-2398 |

Typical (but not exclusive) ranges of properties for some coating grades of asphalt currently used in making roofing materials, likewise specified by ARMA, are given in Table II.

TABLE II

| COATING ASPHALTS | | | |
|---|---|---|---|
| | Limits for Property | | ASTM |
| Property | Minimum | Maximum | Test Procedure |
| Softening Point (R&B) ° F(° C) | 205(96) | 225(107) | D-2398 |
| Flash Point (COC) ° F(° C) | 500(260) | | D-92 |
| Pen at 32° F (0° C)200g,60sec,dmm | 6 | — | D-5 |
| at 77° F (25° C)100g,5sec,dmm | 12 | 25 | D-5 |
| at 115° F (46° C)50g,5sec,dmm | — | 50 | D-5 |
| Ductility at 77° F (25° C),cm | 1.5 | — | D-113 |
| Volatility at 325° F(165° C) 5 hours, % loss | — | 0.5 | D-6 |
| Total Bitumen soluble in trichloroethylene % | 99.5 | | D-2042 |
| High Temperature Stability, Softening Point after Test, R&B | 200(93) | 225(107) | D-2398 |

It has now been found that mixtures of sulfur with the foregoing and other grades of asphalt used in building materials, in proportions between 10 and 55% by weight of the mixtures, can be used to extend the available asphalt and form saturant or coating materials having all the necessary properties for the manufacture of building materials, particularly asphalt type roofing shingles, and that surprisingly and entirely unpredictably, the materials made with such sulfur asphalt mixtures have observably and significantly greater burning resistance or fire resistance than do materials made from the same asphalts without any sulfur admixed therewith.

The invention thus consists in a saturated felt building material comprising a web of paper felt, said web having been saturated at a temperature in the range 240°-350° F (115°-176° C) in a uniform dispersed composition of from 10 to 55% sulfur dispersed in 90 to 45% saturant asphalt then pressed to remove saturant on the surfaces of the web and leave in the web residual saturant of at least 140% by weight of the unsaturated felt, preferably between 160 and 260%. The invention further consists in an asphalt roofing shingle comprising (1) felt backing saturated with an asphalt based saturant and (2) a mineral filled binder mixture coated thereon, the binder for the mineral filler being a uniform sulfur asphalt dispersed composition containing from 10 to 55% by weight of sulfur dispersed in 90 to 45% coating asphalt. The proportions and percentages referred to throughout this specification and the appended claims are proportions and percentages by weight unless otherwise specifically noted herein.

The admixture of elemental sulfur with roofing grades and similar grades of asphalt is readily achieved by blending sulfur in liquid form into the asphalt in fluid form, in the desired proportions at temperatures not over substantially 350° F (176° C) and under conditions of adequate shear whereby the sulfur becomes dispersed in the asphalt; adequate shear can be achieved with high speed stirrers, propeller mixers, pipeline mixers, and other high shear mixing equipment of conventional design appropriately sized for the quantity of material to be mixed. It is known in the art that sulfur, dispersed in asphalts in this manner, dissolves in and/or otherwise combines homogeneously with asphalt up to a proportion between substantially 15 and 25% by weight of the mixture. The proportion that can be thus homogeneously dispersed depends primarily upon the nature of the asphalt. When larger proportions of liquid sulfur are blended with fluid asphalt, the excess above the proportion that is homogeneously dispersed becomes heterogeneously dispersed as fine droplets of liquid sulfur in the fluid asphalt, up to a total in the range between substantially 50 and 60% by weight of total sulfur in the mixture, above which the mixture tends to invert and become a dispersion of fluid asphalt in liquid sulfur. Hence proportions of sulfur above substantially 55% by weight of the total of sulfur and asphalt are unsuitable for and excluded from this invention. On cooling the heterogeneous dispersions of liquid sulfur droplets in fluid asphalt, the sulfur solidifies or crystalizes and remains dispersed as small particles dispersed in the asphalt.

The following examples are given to illustrate various aspects of the invention claimed. The sulfur asphalt mixtures used in these examples were prepared by blending liquid sulfur into a quantity of about 250 grams of fluid asphalt at 300° F (149° C) in a metal container sitting on a 1500 watt electric hot plate and further heated with an electrical heating tape wound around the outside; the liquid sulfur also was at about 300° F (149° C) as it was added, and the amount of it added to the asphalt was regulated to provide the desired proportion of sulfur in the blend, said proportion being 10, 25, or 50% by weight of the blend as indicated in the specific examples. Initially, dispersion of the sulfur in the asphalt was achieved with 1 to 2 minutes mixing using a ½ horsepower (373 watt) turbine mixer equipped with a high speed shear head operating at 5000–7000 rpm. After a few blends it was found that adequate blending was achieved in 2 to 5 minutes mixing by using a "Lightnin" (trademark) Model ARL air powered laboratory size mixer driving a propeller blade at 3000–4000 rpm with air supplied at 100 psi (7 atmospheres) pressure. This produced suitable dispersions of sulfur in asphalt in which the sulfur droplets were substantially all below 50 microns in diameter and the average sulfur droplet size was in the range from 1 to 10 microns. The temperature of the blend was controlled at 300° ± 10° F (149° ± 5° C) by a rheostat controlling the electric current to the heating tape; the hot plate on which the container sat was held at a medium setting.

EXAMPLE 1

This example involves saturation of dry felt material to form felts saturated with various sulfur asphalt mixtures; the felts so formed are of types suitable as roofing felt in constructing built-up roofing (BUR) and as backing for asphalt shingles coated one side with a mineral filled asphalt base coating and optionally surfaced with mineral granules, asphalt roll-type roofing coated one side with a mineral filled asphalt base coating and optionally surfaced with mineral granules, and asphalt roll-type siding coated one side with a mineral filled asphalt base coating and optionally surfaced with mineral granules. The example also illustrates the fire retarding properties of the sulfur asphalt saturated felt as compared to the more combustible nature of the felts saturated with plain saturant asphalt.

For this example, samples of unsaturated dry paper felt were used for saturation with sulfur asphalt blends or with plain asphalt. The asphalt used was a saturant grade of commercial refinery asphalt having a specific gravity at 60° F (15° C) of 1.0209, a flash point (ASTM Method D 92) of 520° F (271° C), a penetration (PEN) at 77° F (25° C) of 35 (ASTM Method D 5), and a ring and ball softening point, by ASTM Method D 36, of 149° F (65° C). Batches of sulfur asphalt saturant were prepared by mixing some of this asphalt with liquid sulfur to form blends at 300° ± 10° F (149° ± 5° C) containing 25% sulfur in the blend; the blending was carried out using the heating and air powered stirring equipment described above. Random samples of the blends were examined visually under a microscope and the sulfur found to be uniformly dispersed after a few minutes of mixing, with an average sulfur droplet size in the range below 10 microns and substantially all sulfur droplets below 50 microns diameter. Sample sheets 12 inches (30.4 cm) square of the dry unsaturated felt, which had a thickness of 0.019 inches (0.48 mm), were dipped by hand into the asphalt or sulfur asphalt blends at about 300° F (149° C) for about 45 seconds to saturate them and simulate passage of a continuous web of felt over rollers through a dip tank. The sheets were allowed to drip for 15 seconds then placed individually between the platens of an hydraulic press, the platens being heated to a temperature in the range 220°–250° F (104°–121° C) where they were subject to pressure which squeezed out excess saturant to leave a saturated felt containing from 180 to 200% of saturant by weight of the dry felt sheet. These saturated felts were properly comparable, except in composition of the saturant when it contained added sulfur, to the commercial asphalt saturated paper felts used in roofing materials. To compare the flame retardancy of the saturants, a modified burning test was arranged from available apparatus. Frames were constructed in the form of a rectangular inverted "U", using ⅛ inch (3.2 mm) thick brass with sides ½ inch (13 mm) wide. A distance of 2 inches (51 mm) clear space between the inside of the sides of the frames was maintained, with 10 inches (254 mm) clear space from the bottom to inside the top of the inverted "U". Two frames were clamped, one each side, to a 3 by 10 inch (76 by 254 mm) sheet of saturated felt to form a flat test piece having an exposed felt edge; this test piece was held with the frame firmly mounted at an angle of 45° and with the exposed felt edge at the bottom. To provide a uniform source of ignition, the taper from a standard Cleveland Open Cup flash apparatus was used. The flame of the taper was adjusted to a length of 3 inches (7.6 cm) and the tip of the taper placed 2 inches (5 cm) from the surface of the felt, ½ inch (13 mm) from the lower edge, so that the flame played onto the surface of the felt for about an inch (2.5 cm). Each sample of material to be ignited was weighed before burning and the collected residue of ash and unburned part of the sample weighed after self extinction. It should be noted that inasmuch as one third of the sample weight was inaccessable for combustion, being clamped between the side pieces so that air necessary for combustion could not reach it, only two thirds of each sample at most could be consumed by combustion.

Part A: To illustrate the burning properties of two samples of felt, of which one was saturated with saturant asphalt and the other with sulfur asphalt saturant containing 25% sulfur prepared as above, the weighed samples of saturated felt were mounted side by side in a fume cupboard and ignited simultaneously with identical taper flames, the flames being held against the samples for 60 seconds and then removed. The asphalt impregnated felt continued to burn for 30 seconds after removal of the flame; it burned to completion, i.e. all the exposed felt was converted to char and ash, and considerable asphalt dripped and dropped from the sample during the test. The burned residue had no strength and collapsed. From the weight of the collected ash and residue it was found that 67% of the consumable part of the original sample weight was lost by burning. In contrast, the sulfur asphalt impregnated felt burned only 19.5 seconds after removal of the flame; the sample formed a layer of intumescent char on the surface of the sheet as combustion progressed from the bottom edge, and the residue of felt and intumescent char remained as an intact sheet inside the frame; very little saturant dripped from the sample during the test. From the weight of the residue, it was found that only 56% of the consumable part of the sample was lost by burning.

Part B: To illustrate the burning properties of thicker sheets of felt saturated as described above, double thicknesses of saturated felt were prepared by placing two 12 inch(30.4 cm) square saturated felt sheets together and laminating them by pressing them together in the heated platens, the saturating and pressing being carried out as described above. The burning properties of two samples saturated with saturant asphalt and sulfur asphalt saturant containing 25% sulfur respectively were compared as described in Part A. With double thickness saturated felt samples (about 0.040 inch or 1.02 mm thick) the asphalt impregnated felt, after a 60 second ignition, burned to completion and totally disintegrated, and 72% of the consumable part of the sample weight was lost by burning; the sulfur asphalt impregnated felt, after a 60 second ignition, extinguished itself after flame had burned 85% of the way to the top of the felt, and only 37.5% of the consumable part of the sample weight was lost by burning. For a comparison with commercial material, a 3 by 10 inch (7.6 by 25.4 cm) sample of asphalt saturated milled felt, part of a roll of commercial asphalt felt retailed locally by building supplies outlets, having a thickness of 0.035 inches (0.89 mm), was mounted and ignited for 60 seconds in the same manner as the foregoing samples; the sample burned completely and disintegrated in 64 seconds after the ignition, and 67% of the consumable part of the sample weight was lost by the burning.

EXAMPLE 2

To illustrate the superior fire retarding properties of asphalt type shingles prepared with proportions of sulfur in the mineral filled asphalt coating thereon, as compared to shingles without sulfur in the mineral filled asphalt coating, numerous sample shingles were prepared by individually loading a mineral filled coating onto commercial asphalt impregnated paper felt, 0.035 inches (0.89 mm) thick. The filler used in the coating was commercial powdered limestone of the type conventionally used in asphalt shingles. The asphalt impregnated backing felt also was a commercial product of a type conventionally used in asphalt shingles; it contained no added sulfur in its asphalt saturant. In preparing the various filled coating compositions used in this example, the samples of asphalt used were commercial 210 Melt coating asphalt, having an API gravity at 60° F (15.5° C) of 6.1, a specific gravity of 60° F (15.5° C) of 1.028, a flash point (COC) of 525° F (274° C) by ASTM Method D 92, a softening point by ASTM Method D 36 of 217° F (103° C) and a penetration by ASTM method D 5 at 77° F (25° C) (PEN, 100g, 5 sec), of 14. The samples of asphalt were individually heated to 300° ± 10° F (149° ± 5° C) in the heating equipment described above, and those that were to include sulfur had liquid sulfur, in weight proportions of 10, 25, or 50% by weight of the sulfur asphalt blend respectively added to the appropriate samples at a temperature of 300° ± 10° F (149° ± 5° C), so that temperature of the blend did not rise above the foregoing range during blending of sulfur and asphalt. To the liquid asphalt or sulfur asphalt blends at this temperature, weighed quantities of the powdered limestone filler likewise preheated to the same temperature range were added with stirring to form filled coating composition, using the same mixer but at a lower speed than was used in dispersing liquid sulfur in asphalt uniformly; the rotational speed of the mixer for most efficient wetting of the filler with asphalt and sulfur asphalt blends was about one-tenth that used to disperse sulfur in asphalt. Temperature of the filled coating compositions was thermostatically controlled in the range 300° ± 10° F (149° ± 5° C) during this mixing, and the proportion of filler added in each case was 50% by weight of the filled composition. To prepare a sample shingle, a 12 × 14 inch (30.5 × 35.6 cm) section of the asphalt impregnated felt saturant paper was placed on the lower jaw of a 50 ton hydraulic press and loaded with a 200 gram portion of hot filled coating composition which was roughly spread by pouring between metal spacers about 0.085 inches (2.15 mm) thick. This assembly was then covered with a sheet of "Teflon" (trademark) plastic coated quick release paper and the jaws of the press closed to subject the assembly to a pressure of 10 tons (9100 kg) for 5 minutes. During preparation and pressing of the shingle thus formed, the jaws of the press were maintained at 220° ± 10° F (104° ± 5° C). On release from the press the shingle was placed in cool water and the quick release paper and spacers were removed therefrom. Thickness of the shingle at various points was determined and a suitable 3 × 10 inch (76.5 × 254 mm) section having substantially uniform thickness of 0.085 inches (2.15 mm) cut out to serve as a test sample for inflammability evaluation. These test sections, except for the composition of the mineral filled coating where the latter contained added sulfur, were properly comparable to equal size test sections cut from commercial asphalt roofing shingles coated with 50% mineral filled asphalt coating. To compare the inflammability of the various samples they were in turn mounted in the test frames described in the previous example and ignited for 60 seconds with the standard taper in the manner previously described. Some of the samples were weighed before ignition and the residues thereof after self extinction were collected and weighed to determine the weight loss in the test. Visual examination of the shingles after self extinction of the flame showed that pure asphalt shingles burned readily after ignition and generally burned to completion with one ignition. Large amounts of asphalt were observed dripping at the lower edge during the burn. The asphalt shingle was barely intact after the burn and the felt paper backing had numerous cracks and holes burned entirely through. In contrast, shingles having sulfur asphalt blends in the coating produced an intumescent layer of char at the base of the flame as burning progressed, and this layer is believed to have been responsible for the more rapid extinction of the flames and the elimination of the run-off of asphalt from the shingle; after completion of the burning, which usually required two or three ignitions by the taper, the shingles still were intact and had no holes burned through them. To assist in maintaining the objectivity of the results, many of the burning tests were carried out in pairs simultaneously with adjacent duplicate frames and tapers, so that stray drafts could not cause a distorted result for any one type of shingle sample. The weight loss on burning to completion, expressed as a percentage of the consumable part of the shingle weight, was the best indicator of the fire resistant qualities of the samples in these comparisons, with the smaller weight losses indicating the best fire resistance. It was observed quantitatively that shingle samples having no sulfur in the coating asphalt binder lost between 67 and 85% of their consumable weight on burning to completion, shingle samples having 10% sulfur in the coating binder lost between 33 and 47% of their consumable weight on burning to completion, shingle samples containing 25% sulfur in the coating binder lost around 30%, and shingle samples containing 50% sulfur in the coating binder lost only around 13% of their consumable weight on burning to completion. As an additional simple comparison to illustrate the significance of weight loss on combustion and the relative combustion resistance of shingles containing sulfur in the asphalt coating, a sample of oxidized coating asphalt which had been oxidized in presence of 0.3% ferric chloride was used to prepare shingles samples as described above; these shingle samples contained no added sulfur in the binder coating. (Commercial asphalt shingles made with $FeCl_3$ oxidized coating asphalt have a fire underwriters' rating of Class A for roofs, but regular commercial asphalt shingles made with normally oxidized coating asphalt have only a Class B rating). The sample shingles made as described herein with $FeCl_3$ oxidized coating asphalt were found to lose between 52% and 57% of their consumable weight on burning to completion as described in the foregoing test. Thus the shingles containing as little as 10% sulfur in the asphalt coating binder show greater burning resistance than comparable shingles of fire resistance warranting a Class A rating.

EXAMPLE 3

This example illustrates the superiority of an asphalt type shingle in which the saturant in the felt backing and the binder in the filled coating each contain 25% sulfur and 75% asphalt. The sulfur asphalt saturant blend was prepared exactly as described in Example 1 and laminated sample sheet of 0.040 inches (1.02 mm) thickness of saturated felt prepared therefrom, as described in Example 1, Part B. The saturated sheet then was coated exactly as described in Example 2 with a 50% mineral filled coating having 25% sulfur, 75% 210 Melt coating asphalt in the binder to obtain a sample sheet having a thickness of about 0.085 inches (2.15 mm). A 3 × 10 inch (7.6 × 25.4 cm) section of substantially uniform 0.085 inch (2.15 mm) thickness cut from the sample then was mounted and ignited for 60 seconds as described in the previous examples. The flame, after the ignition period, extinguished itself after burning 3 inches (7.6 cm) up the test piece in 6 seconds. Extensive intumescent char developed at the base of the flame as the burn spread across the test piece. The weight loss during the initial burning was 3.6%. On re-ignition, with the taper flame maintained continuously against the shingle to sustain combustion, the sample finally burned to completion. The weight loss on burning to completion was still only 23.2% of the consumable part of the sample. It can be noted for comparison with Example 2 that the shingles with 25% sulfur 75% asphalt in the binder of the filled coating, but with no sulfur in the saturating asphalt of the backing, lost around 30% of their consumable weight on burning to completion.

In addition to the samples and test pieces prepared and tested as described in the foregoing examples, numerous other samples and test pieces have been prepared to assess other properties of asphalt type roofing material in which sulfur is substituted for part of the asphalt in the material in either the mineral filled asphalt coating or in the saturant for saturated felt. Such assessments included accelerated weathering evaluation in an Atlas Xenon Weatherometer as described in ASTM Method D 1669, physical property measurements on the sulfur asphalt blends for comparison with the properties measured on felt saturant and coating (industrial) grade asphalts, and an environmental evaluation to assess potential atmospheric pollution problems caused by added sulfur. Such assessments have revealed that no detrimental properties were developed by inclusion of sulfur in the samples. Depending on its proportion in a liquid sulfur asphalt blend, the sulfur lowers the viscosity of the liquid material at temperatures above substantially 230° F (110° C), thus permitting the use of lower temperatures in handling, mixing, and applying the material. Thus as sulfur asphalt blends are most conveniently prepared and applied at temperatures in the range around 300° ± 10° F (149° ± 5° C), this does not preclude their use in manufacture as asphalt type roofing materials, although mineral filled asphalt coatings in the prior art have generally been applied to shingles at somewhat higher temperatures, e.g. around 350° F (175° C) and paper felt has generally been saturated with asphalt at still higher temperatures, e.g. around 400° F (204° C). Temperatures higher than 300° ± 10° F (149° ± 5° C) can be used with sulfur asphalt blends if one is prepared to install and use pollution abatement equipment to remove the sulfur related pollutants that are evolved.

The foregoing examples have illustrated various roofing materials of the type based on webs of asphalt saturated paper felt, and have shown that uniform blends of sulfur and corresponding asphalt containing from 10 to 55% by weight of sulfur in the blend can be substituted for the saturant asphalt used in such materials, or for both. Although not exemplified herein, it will be obvious that finishing coats of reflective and/or decorative finely divided stone can be applied on top of the mineral filled sulfur asphalt coating on the roofing materials described herein. Likewise the webs of paper felt illustrated herein are obviously equivalent to, and could be substituted by, webs of rag felt, which would be as readily combustible as paper felt and can benefit equally by saturation and/or coating with sulfur asphalt blends in lieu of regular saturating or coating asphalts as disclosed herein. Furthermore, webs of asbestos fibre felt, or felted or woven fiberglass webs, which in themselves are non-combustible, can benefit from the invention when saturated and/or coated with sulfur asphalt blends in lieu of regular asphalt saturants or coatings; the webs saturated and/or coated with the sulfur asphalt blends in this way show corresponding improvement in burning resistance over the burning resistance of non-combustible webs saturated and/or coated with regular asphalts. Numerous other modifications of the various expedients described can be made without departing from the scope of the invention which is defined in the following claims.

We claim:

1. A saturated felt building material comprising a web of paper felt, said web having been (1) saturated at a temperature in the range 240° F–350° F (115° C–176° C) in a uniform dispersed composition of from 10 to 55% sulfur dispersed in 90 to 45% saturant asphalt, with any of the sulfur in the composition which is not dissolved in the asphalt being dispersed as finely divided particles in the size range below 50 microns, then (2) pressed to remove saturant on the surface of the web and leave in the web residual saturant of at least 140% by weight of the unsaturated felt.

2. A saturated felt building material as claimed in claim 1 in which the saturant is between 160 and 260% by weight of the unsaturated felt.

3. An asphalt roofing shingle comprising (1) felt backing saturated with an asphalt based saturant and (2) a mineral filler binder mixture coated thereon, the binder for the mineral filler being a uniform sulfur asphalt dispersed composition containing from 10 to 55% by weight of sulfur dispersed in 90 to 45% coating asphalt, with any of the sulfur in the composition which is not dissolved in the asphalt being dispersed as finely divided particles in the size range below 50 microns.

4. An asphalt roofing shingle as claimed in claim 3 in which the saturant in the felt is a uniform sulfur asphalt blend containing from 10 to 55% by weight of sulfur and 90 to 45% saturant asphalt.

5. An asphalt shingle as claimed in claim 3 in which the felt backing is a saturated felt as claimed in claim 1.

6. A saturated felt building material having an asphalt base saturant therein and optionally having a mineral filler asphalt base binder mixture coated thereon, wherein at least one of the asphalt base saturant in the felt and the asphalt base binder is a uniform dispersed composition of from 10 to 55% sulfur dispersed in 90 to 45% asphalt, with any of the sulfur in the composition which is not dissolved in the asphalt being dispersed as finely divided particles in the size range below 50 microns.

7. A saturated felt building material as claimed in claim 1 in which the dispersed composition contains between substantially 25 and 55% sulfur dispersed in substantially 75 to 45% asphalt.

8. An asphalt roofing shingle as claimed in claim 3, wherein the sulfur asphalt dispersed composition contains from 25 to 55% sulfur dispersed in 75 to 45% coating asphalt.

9. A saturated felt building material as claimed in claim 6 in which the uniform dispersed composition contains from 25 to 55% sulfur dispersed in 75 to 45% asphalt.

* * * * *